US009797211B2

(12) United States Patent
Xu et al.

(10) Patent No.: US 9,797,211 B2
(45) Date of Patent: Oct. 24, 2017

(54) SUBTERRANEAN VIBRATOR WITH LATERAL VIBRATION FEATURE

(71) Applicant: BAKER HUGHES INCORPORATED, Houston, TX (US)

(72) Inventors: Yingqing Xu, Tomball, TX (US); Steve Rosenblatt, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 613 days.

(21) Appl. No.: 14/297,242

(22) Filed: Jun. 5, 2014

(65) Prior Publication Data

US 2014/0284055 A1 Sep. 25, 2014

Related U.S. Application Data

(63) Continuation of application No. 13/213,796, filed on Aug. 19, 2011, now Pat. No. 8,936,076.

(51) Int. Cl.

| | |
|---|---|
| ***E21B 23/04*** | (2006.01) |
| ***E21B 28/00*** | (2006.01) |
| ***E21B 31/113*** | (2006.01) |
| ***E21B 31/00*** | (2006.01) |

(52) U.S. Cl.

CPC ..... *E21B 28/00* (2013.01); *E21B 23/04* (2013.01); *E21B 31/005* (2013.01); *E21B 31/113* (2013.01); *E21B 31/1135* (2013.01)

(58) Field of Classification Search

CPC .. E21B 31/005; E21B 31/113; E21B 31/1135; E21B 28/00; E21B 23/04

See application file for complete search history.

(56) References Cited

U.S. PATENT DOCUMENTS

| | | | | |
|---|---|---|---|---|
| 2,894,724 | A * | 7/1959 | Andrew | E21B 31/113 166/177.6 |
| 5,080,189 | A | 1/1992 | Cole | |
| 6,474,421 | B1 | 11/2002 | Stoesz | |
| 6,502,638 | B1 | 1/2003 | Stoesz | |
| 6,675,909 | B1 | 1/2004 | Cowart et al. | |
| 6,725,932 | B2 | 4/2004 | Taylor et al. | |
| 6,782,951 | B2 | 8/2004 | Taylor et al. | |
| 6,866,104 | B2 | 3/2005 | Stoesz et al. | |
| 6,877,561 | B2 | 4/2005 | Richard et al. | |
| 7,077,205 | B2 | 7/2006 | Eddison | |
| 7,264,055 | B2 | 9/2007 | Mody et al. | |
| 7,575,051 | B2 | 8/2009 | Stoesz et al. | |
| 8,604,634 | B2 * | 12/2013 | Pabon | E21B 41/0085 166/65.1 |

OTHER PUBLICATIONS

National Oilwell Varco Presentation; Agitator System, NOV.com, 1-24, Nov. 2011.

National Oilwell Varco Presentation; Super Fishing BHA, NOV.com, 1-31, Nov. 2011.

* cited by examiner

*Primary Examiner* — Nicole Coy

(74) *Attorney, Agent, or Firm* — Steve Rosenblatt

(57) ABSTRACT

A vibratory tool for use in a tubular string to prevent sticking or to release a stuck string features a fluid operated dart valve working in conjunction with an impact sleeve to deliver continuous axial jarring blows in opposed directions as long as flow is maintained. Movement of one of those components axially in opposed directions opens and closes access to opposed lateral ports so that a lateral vibration is also established as flow cyclically occurs and stops sequentially at opposed lateral outlets.

19 Claims, 5 Drawing Sheets

SUBTERRANEAN VIBRATOR WITH LATERAL VIBRATION FEATURE

This application is a continuation of U.S. patent application Ser. No. 13/213,796, filed on Aug. 19, 2011.

FIELD OF THE INVENTION

The field of the invention is vibrators for subterranean use and more particularly vibrators that function through flow in a string and more specifically where there is a lateral component to the vibration.

BACKGROUND OF THE INVENTION

Vibration can be a cause or a solution of problems in subterranean locations. It can be a quantity that has to be controlled so that equipment or drill strings do not fatigue. It can be a force that creates acoustic signals that can be sensed in a variety of situations to monitor well conditions as for example in U.S. Pat. No. 5,080,189. It can be used to advantage to advance screens into a gravel pack using an augur in combination with a vibrator as shown in U.S. Pat. No. 6,877,561. Vibrators can be configured to pass tools until needed to function as a vibrator as shown in U.S. Pat. No. 6,866,104.

Typically, a vibrator is used in a tool string being run in to avoid getting stuck or to try to get the string to release if it gets stuck for a variety of reasons such as hole collapse in open hole when advancing through unconsolidated formations. One such vibrator whose basics will be discussed in detail below is U.S. Pat. No. 6,474,421. Other relevant art includes U.S. Pat. Nos. 7,575,051; 6,675,909 and 7,264,055.

FIGS. 1*a*-1*c* are a simplified half section presentation of the vibrating tool in U.S. Pat. No. 6,474,421 that provides flow induced axial vibration. The string 10 supports the housing 12. There is a flowpath 14 with a movable dart valve 16 in the flow path 14. The dart valve 16 has a closed nose 18 and lateral outlets 20. A spring 22 bears on shoulder 24 in the housing 12 to push the dart valve 16 uphole and in an opposite direction as the flow from the surface represented by arrow 26. An impact sleeve 28 is biased uphole by spring 30 supported from surface 32 in housing 12. Flow from the surface, represented by arrow 26 moves the dart valve 16 toward the impact sleeve 28. Initially the nose 18 contacts the impact sleeve 28 to stop flow and to initiate tandem movement of the dart valve 16 and the impact sleeve 28. Both springs 22 and 30 are compressed as this happens. The dart valve 16 is abruptly stopped by shoulder 34 for a downhole oriented axial pounding blow and the dart valve 16 separates from the impact sleeve 28. This opens a gap between the dart valve 16 and the impact sleeve 28 so that flow can start again. With the onset of flow, the spring 30 drives up the impact sleeve 28 against the shoulder 36 for a jarring uphole blow in the axial direction.

While this design has worked well it is limited by the axial direction of the opposed vibration impacts as the tool cycles continuously as described above with the flow continuing. What is needed and provided by the present invention is a way to also provide lateral vibration in conjunction with the axial vibration while still keeping the device simple for continuing trouble free operation. Those skilled in the art will better appreciate the present invention that provides vibration in lateral directions as well as axial vibration for more effective release of stuck strings or to better prevent sticking in the first place by a review of the description of the preferred embodiment and the associated drawings while at the same time realizing that the full scope of the invention is to be determined by the appended claims.

SUMMARY OF THE INVENTION

A vibratory tool for use in a tubular string to prevent sticking or to release a stuck string features a fluid operated dart valve working in conjunction with an impact sleeve to deliver continuous axial jarring blows in opposed directions as long as flow is maintained. Movement of one of those components axially in opposed directions opens and closes access to opposed lateral ports so that a lateral vibration is also established as flow cyclically occurs and stops sequentially at opposed lateral outlets.

DETAILED DESCRIPTION OF THE PREFERRED EMBODIMENT

Figure 1A:
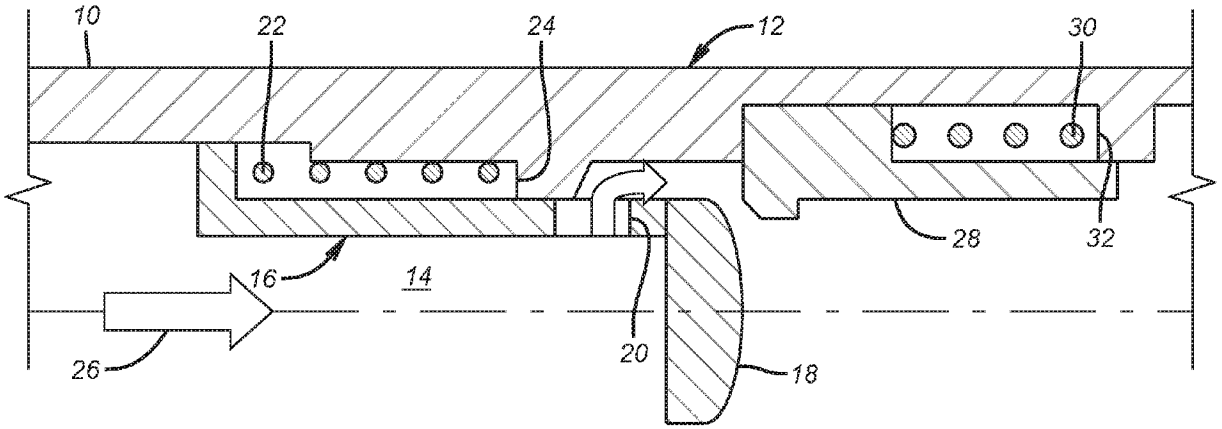
(PRIOR ART) FIG. 1a
FIG. 1*a* shows the position of the parts as the dart valve starts moving in response to flow in a prior art design.
Figure 1B:
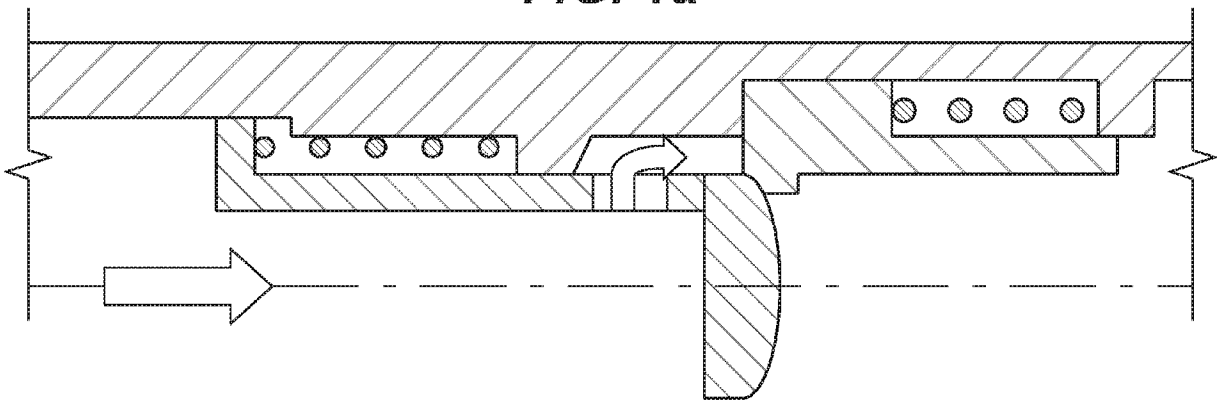
(PRIOR ART) FIG. 1b
FIG. 1*b* is the view of FIG. 1 at the point flow stops when the dart valve engages the impact sleeve.
Figure 1C:
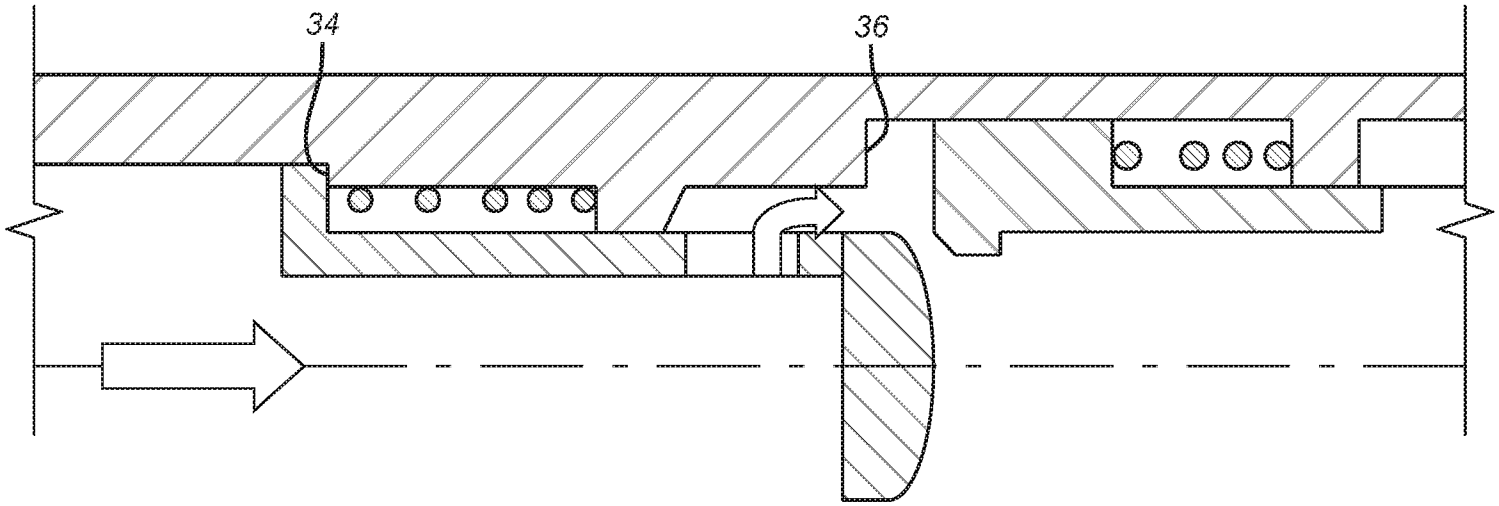
(PRIOR ART) FIG. 1c
FIG. 1*c* is the view of FIG. 1*b* after the dart valve hits a travel stop and separates from the impact sleeve allowing flow to resume and the impact sleeve to move up under spring force and strike an anvil for an uphole blow.
Figure 2:
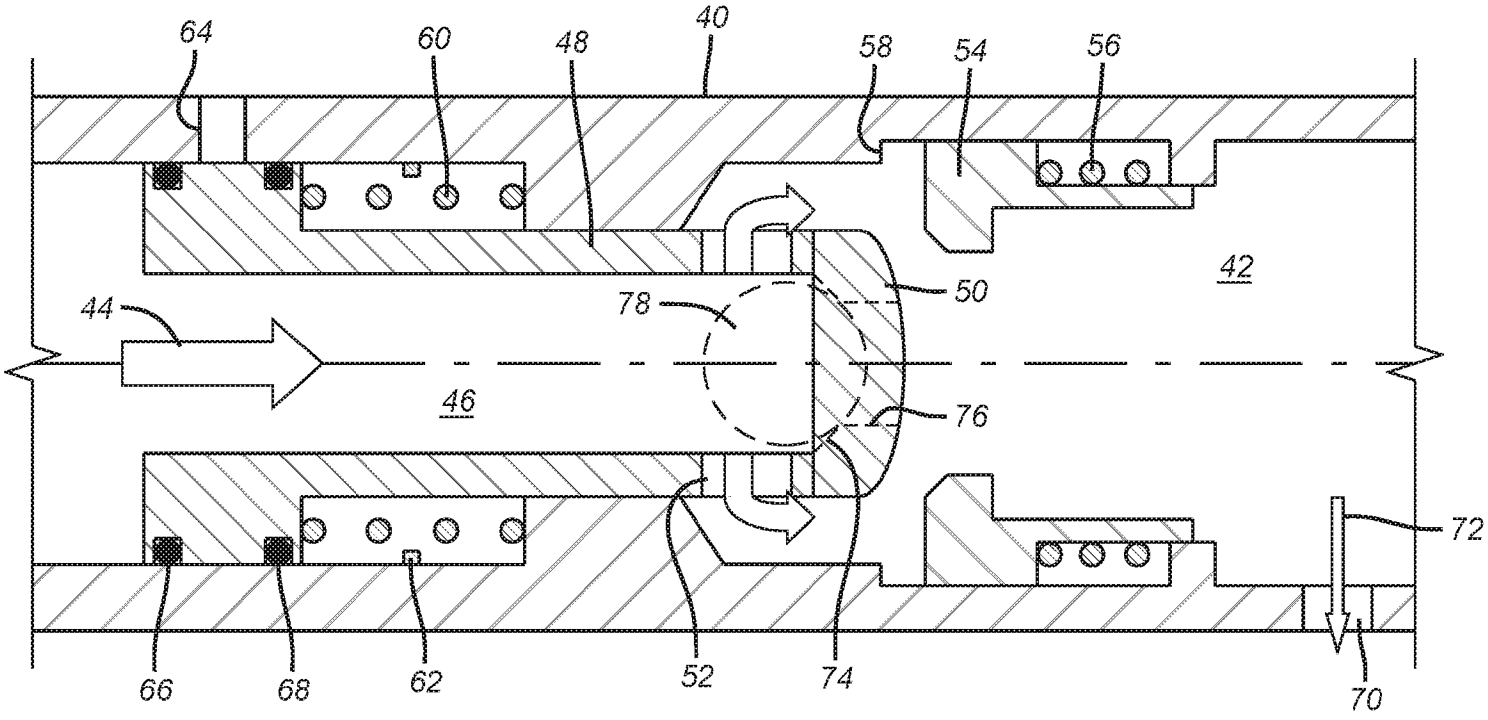
FIG. 2 is the present invention with the upper lateral port closed and the lower lateral port open with flow driving the dart valve to the impact sleeve.

Referring to FIG. 2, a housing 40 is part of a tubular string such as a drill string that is not shown. A flow path 42 extends through housing 40. Flow is in the direction of arrow 44. Flow enters passage 46 in dart valve 48 that has a nose 50 and one or more lateral openings 52. An impact sleeve 54 is biased in the uphole direction by spring 56. Shoulder 58 is the anvil for impact sleeve 54 for axial uphole jarring blows. Spring 60 biases the dart valve 48 in the uphole direction. A schematically illustrated shoulder 62 is an anvil for axial downhole blows delivered by the dart valve 48. Upper lateral port or ports 64 is initially covered by the dart valve 48 with seals 66 and 68 straddling upper lateral port or ports 64. Lower lateral port 70 is open initially and closes when the nose 50 abuts impact sleeve 54 as shown in FIG. 3.

The operation of the vibrator is as follows. Flow represented by arrow 44 goes through ports 52 and starts the dart valve 48 moving against the force of spring 60. Preferably the nose 50 contacts the impact sleeve 54 first to cut off flow, represented by arrow 72, to the lower lateral port 70. Movement of the dart valve 48 toward the impact sleeve 52 not only cuts off flow 72 but it also exposes upper lateral port 64 as seal 66 moves past the port 64 as shown in FIG. 3, thus creating alternating flow through ports 64 and 70.

Figure 3:
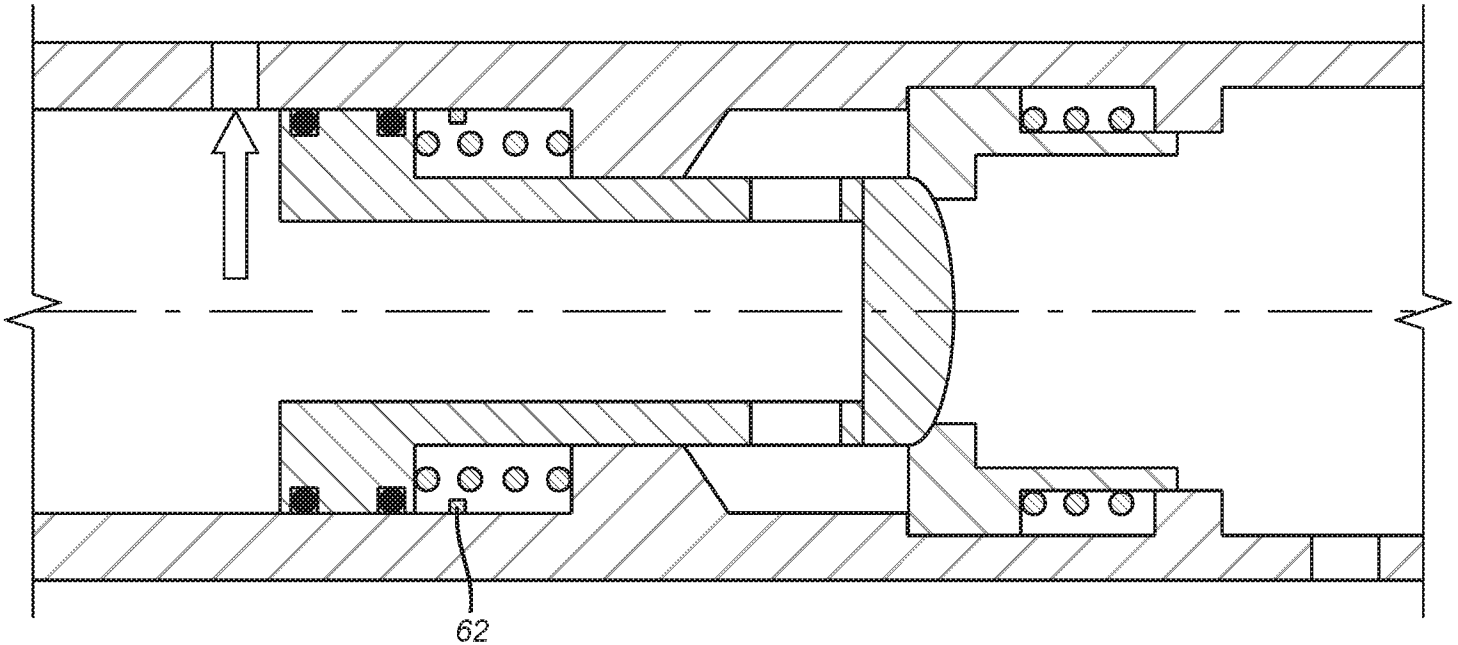
FIG. 3 is the view of FIG. 2 with the dart valve against the impact sleeve to close off the lower lateral port and to open the upper lateral port.

Note that movement of the dart valve 48 and impact sleeve 54 past the FIG. 3 position and in tandem is still possible until the dart valve 48 hits the shoulder 62 to stop the progress of the dart valve 48 as a downhole jarring blow is delivered. Continuing pressure from above will separate the impact sleeve from the dart valve 48 that has hit its anvil 62. At this point flow is re-established and spring 60 returns the dart valve 48 to the FIG. 2 position where the upper lateral port 64 is closed. Separation of the dart valve 48 and the impact sleeve 54 re-establishes flow to the lower lateral port 70. The impact sleeve is pushed by spring 56 against shoulder 58 to deliver an uphole axial jarring blow. The cycle repeats as long a flow or pressure is maintained.

Figure 5:
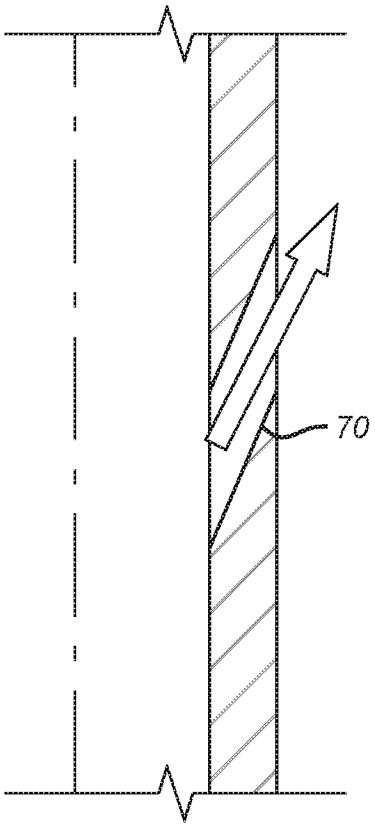
FIG. 5 shows the lower lateral ports with one of several orientations where the axis points uphole, downhole or/and tangentially.
Figure 4:
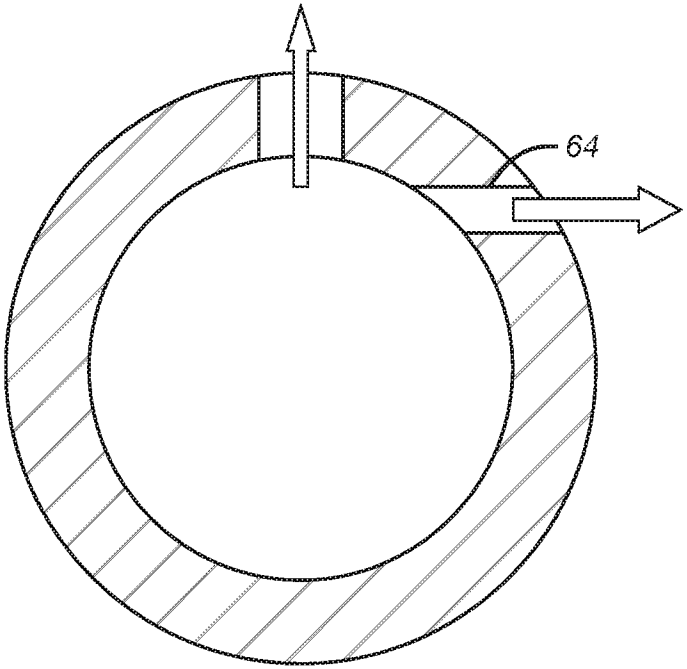
FIG. 4 shows the upper lateral ports with one of several possible orientations where the hole axis does not pass through the housing centerline.

As a result the lateral ports 64 and 70 are sequentially used for flow to establish a lateral vibration pattern in the housing 40 to aid in getting the housing 40 and the attached string such as a drill string unstuck or to prevent the housing 40 from sticking at all. It should be noted that depending on the part configurations the ports 64 and 70 can be open sequentially or they can have some overlap as the lateral flow regime switches back and forth. The openings 64 and 70 can be in a single or multiple rows and the opening sizes as between openings 64 and 70 can be the same or different. The arrangements at either end can be ordered or random and all the openings 64 can be the same size or different sizes. The openings can be centered at 90 degrees to the axis of the housing 40 or the center axis could be shifted so that it doesn't cross the axis of the housing 40, such as in FIG. 4, putting some or all of the openings 64 or 70 at a tangential orientation where the exiting flow induces a spiral motion in one direction for openings 64 and in the opposite direction for openings 70. Alternatively, openings 64 and 70 can be tangentially oriented in the same direction. Alternatively, some of the openings 64 or 70 can be tangential and others at 90 degrees as shown. The skew of the openings can also vary in the uphole and downhole direction as well as in a perpendicular plane to the axis of housing 40. Some of these variations are illustrated in FIG. 5. Alternatively, wear inserts can be placed in the openings to protect the housing 40 from high velocities at the openings 64 or 70.

Optionally, the nose 50 can have a seat 74 around a passage 76 that stays open so that tools can pass through the vibrator until it needs to be deployed. When it is time to activate the vibrator an object 78 is landed on seat 74 to close off passage 76 and the operation from there is the same as described above for a solid nose 50.

The above description is illustrative of the preferred embodiment and many modifications may be made by those skilled in the art without departing from the invention whose scope is to be determined from the literal and equivalent scope of the claims below:

We claim:

1. A method of release of a stuck tubular string that defines an annular space in a subterranean location, comprising:

providing an axial vibration assembly in a housing connected to the stuck tubular string that has a selectively closable passage, said passage, when open, allows a tool to pass through the stuck tubular string and said passage, when closed, enables said axial vibration assembly to operate;

creating axial vibrations by movement in opposed directions of said axial vibration assembly, when enabled, responsive to an applied force thereto;

creating lateral vibration through at least one wall opening in said housing that is oriented to impart lateral force on said housing when fluid flows through said passage.

2. The method of claim 1, comprising:

providing multiple openings as said at least one wall opening.

3. The method of claim 2, comprising:

axially spacing said openings.

4. The method of claim 3, comprising:

circumferentially offsetting said openings.

5. The method of claim 3, comprising:

providing axes for said openings that are in parallel or oblique planes.

6. The method of claim 5, comprising:

axes of said openings intersect or are skewed from an axis of said housing.

7. The method of claim 2, comprising:

alternatively opening said openings based on the direction of movement of said axial vibration assembly.

8. The method of claim 2, comprising:

using a dart valve as said axial vibration assembly;

moving said dart valve in opposed directions with applied pressure in said stuck tubular string;

opening different openings sequentially as said dart valve changes movement direction.

9. The method of claim 8, comprising:

extending said passage through said dart valve;

providing a seat for said object to land in the dart valve and obstruct said passage through said dart valve.

10. The method of claim 8, comprising:

allowing different openings to be open at least in part as one said opening is closing and another said opening is opened.

11. The method of claim 1, comprising:

selectively opening and closing said at least one opening with said axial vibration assembly.

12. A method of release of a stuck tubular string that defines an annular space in a subterranean location, comprising:

providing an axial vibration assembly in a housing having an outermost wall and connected to the stuck tubular string;

selectively closing a passage through said axial vibration assembly to enable axial vibration;

creating lateral vibration and alternating flow through axially spaced outermost wall openings in said housing that define a straight flowpath for fluid exiting said housing and that are oriented to impart lateral force on said housing when fluid cyclically flows through said outermost wall openings at axially spaced locations and wherein said outermost wall openings are oriented in different directions from each other at said axially spaced locations.

13. The method of claim 12, comprising:

alternatively opening said outermost wall openings based on the direction of movement of said axial vibration assembly.

14. The method of claim 12, comprising:

circumferentially offsetting said outermost wall openings.

15. The method of claim 12, comprising:

orienting axes for said outermost wall openings in parallel or oblique planes.

16. The method of claim 12, comprising:

axes of said outermost wall openings intersect or are skewed from an axis of said housing.

17. A method of release of a stuck tubular string that defines an annular space in a subterranean location, comprising:

providing an axial vibration assembly in a housing having an outermost wall and connected to the stuck tubular string;

creating lateral vibration through axially spaced outermost wall openings in said housing that define a straight flowpath for fluid exiting said housing and that are oriented to impart lateral force on said housing when fluid cyclically flows through said outermost wall openings;

using a dart valve as said axial vibration assembly;

moving said dart valve in opposed directions with applied pressure in said stuck tubular string;

opening said outermost wall openings sequentially as said dart valve changes movement direction.

18. The method of claim 17, comprising:

extending said passage through said dart valve;

providing a seat for said object to land in the dart valve and obstruct said passage through said dart valve.

19. The method of claim 17, comprising:

allowing different openings to be open at least in part as one said opening is closing and another said opening is opened.

* * * * *